US006308743B1

(12) United States Patent
Debaes et al.

(10) Patent No.: US 6,308,743 B1
(45) Date of Patent: Oct. 30, 2001

(54) DEVICE FOR WEFT CANCELLATION ON A WEAVING MACHINE

(75) Inventors: Johnny Debaes, Moorslede; Andre Dewispelaere, Marke, both of (BE)

(73) Assignee: N. V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/567,028

(22) Filed: May 8, 2000

(30) Foreign Application Priority Data

May 12, 1999 (BE) ..... 9900344

(51) Int. Cl.[7] ..... D03D 47/38
(52) U.S. Cl. ..... 139/450
(58) Field of Search ..... 139/453

(56) References Cited

U.S. PATENT DOCUMENTS 3,921,678 * 11/1975 Palencher ..... 139/453
4,653,544 3/1987 Vandeweghe et al. .
4,913,195 * 4/1990 Speich ..... 139/453
5,492,153 * 2/1996 Stacher et al. ..... 139/453
5,694,982 12/1997 Debaes .
6,026,864 * 2/2000 Corain et al. ..... 139/453

FOREIGN PATENT DOCUMENTS 1007905 11/1995 (BE) .
0104440 4/1984 (EP) .

* cited by examiner

*Primary Examiner*—Andy Falik
(74) *Attorney, Agent, or Firm*—James Creighton Wray; Meera P. Narasimhan

(57) ABSTRACT

Device for weft cancellation on a weaving machine offers wefts (1), (2), (3) to at least one weft insertion (5), (6), (7) on a weaving machine, which can be operated in order either to bring a weft within the feed area of a weft insertion or to hold it out of this feed area, to effect a weft cancellation. The device has a yarn carrier (19) which can be moved by a weaving machine drive in order to bring a weft (2) within the aforementioned feed area. The device can be operated in order to bring the yarn carrier (19) and a weft (2) into a first and a second mutual position, in which this weft (2) can or cannot be carried along by the yarn carrier (19) within the aforementioned feed area. A first embodiment comprises a movable pusher element (22) that can be operated in order to bring a weft (2) into a first and into a second position in relation to the yarn carrier (19). In a second embodiment the yarn carrier (19) can itself be brought into two different positions.

11 Claims, 16 Drawing Sheets

DEVICE FOR WEFT CANCELLATION ON A WEAVING MACHINE

BACKGROUND OF THE INVENTION

This invention relates to a device for passing weft yarns to at least one weft insertion means on a weaving machine, which can be operated in order either to bring a weft within the weft feed area of the weft insertion means so that a weft can be inserted, or to hold it out of this feed area to effectuate a weft cancellation.

This device also relates to a weaving machine provided with such a offering device for wefts.

Known weaving machines comprise a mechanism for inserting wefts between warp yarns. Such a mechanism comprises one or more weft insertion means, such as for example rapiers, which can be operated in order in the course of successive weft insertion cycles to bring a respective weft into a shed formed between warp yarns.

In order to be able to weave certain weave constructions or to be able to weave in an efficient manner it is necessary to prevent the insertion of one of more wefts in the course of certain insertion cycles. By means of the above described device this can be effected automatically. The prevention of the insertion of a weft by a weft insertion means is generally referred to by the term "weft cancellation".

Such offering devices for wefts with which weft cancellations can be effected automatically are generally known.

The known devices comprise weft cutters which are provided in order after each weft insertion to cut off the piece of weft yarn, inserted in the fabric, from the weft yarn fed from the supply package, and in order, after cutting off the piece of weft, to clamp the free extremity of the fed weft. These weft cutters are connected to the weaving batten and therefore move back and forth with every beating-up. The clamped weft is brought below the movement path of a rapier in the course of the return movement of the weaving batten. These devices furthermore also comprise a swivelling arm with a guiding eye for the weft. The swivelling arm is rotatably connected to the frame of the weaving machine and can be operated in order whether or not to bring the weft extending through the guiding eye above the movement path of the rapier.

If a weft has to be inserted the weft cutters are operated in order to cut through and clamp the weft. The clamping means move with the weaving batten and bring the weft under the rapier movement path. The swivelling arm is at that moment rotated to a position in which the guiding eye brings the weft above the movement path of the rapier, so that the part of the weft extending between the clamping means and the guiding eye is within the feed area of the rapier.

If on the other hand a weft cancellation has to be effected the weft cutters are not operated in order to cut through the weft. The weft therefore remains connected to the fell of the fabric and is also not clamped by the clamping means. Because of this the weft is also not carried to below the rapier movement path, with the beating-up movement of the batten. The swivelling arm is also not operated to bring the weft to above this movement path, so that the weft remains outside the feed area of the rapier.

A disadvantage of these known devices is that the swivelling levers and their operation are rather complex and expensive.

SUMMARY OF THE INVENTION

The purpose of this invention is to provide such a device which on the one hand is simpler and cheaper than the known devices, and which on the other hand can nevertheless operate in a very efficient manner and enables a proper and fast operation of the weaving machine, without any reduction of quality for the fabrics.

This objective is achieved by providing a device with the characteristics mentioned in the first paragraph of this specification, which furthermore comprises a yarn carrier which is provided in order to be moved by a weaving machine drive in order to bring a weft within the aforesaid feed area, and which can be operated in order to bring the weft and the carrier into a first and a second mutual position, while the weft in the first mutual position can, and in the second mutual position cannot be carried along by the yarn carrier to the aforesaid feed area.

The movement of the yarn carrier can among others be effected by the weaving batten drive, whereby the yarn carrier is for example attached to a part of the weaving machine moving synchronously with the movements of the weaving batten. The offering of a weft to a weft insertion means therefore no longer requires a separately operable drive mechanism. The expensive and complex swivelling levers are therefore no longer necessary. The performance of a weft cancellation can occur by so altering the mutual position of the weft and the yarn carrier that this weft cannot be carried along by the yarn carrier. This can be effected in a very efficient manner with simple means.

With a weft cancellation the piece of weft that was inserted in the course of the previous insertion cycle is not cut off from the weft supply means, so that this remains connected to the fabric. The weft is not clamped by the moving weft cutters during the beating-up movement and is with use of the device according to this invention furthermore also not carried along by the yarn carrier, so that there is no danger at all that the weft is withdrawn from the fell of the fabric.

This danger would namely exist if the known swivelling levers with guiding eye were just to be replaced by a guiding eye that is permanently attached to the weaving batten. Indeed with a weft cancellation the non-cut-off weft yarn extending through the guiding eye would in the course of the return movement of the weaving batten, as a result of the frictions in the guiding eye, be withdrawn from the fell of the fabric. The quality of the fabric would be reduced because of this. More specifically faults would be discovered in the pile height.

Especially with fast-running weaving machines these frictions would also lead to a non-cut-off weft no longer being able to be held sufficiently under tension. With an offering following thereafter of this weft to a weft insertion means, the chance would be inadmissibly great that the weft is not properly stretched, and consequently is not carried along by the weft insertion means. The quality of the fabric would therefore also be reduced through so-called weft faults. This would especially occur with the weaving of thicker weft yarns, such as e.g. jute and polypropylene yarns.

With use of the device according to this invention the weft is in the course of a weft cancellation not subject to frictions. The wefts can consequently be held sufficiently under tension in order to prevent weft faults, and are not withdrawn from the fell of the fabric. The quality of the fabric therefore remains guaranteed, even when weaving with fast-running weaving machines or with interweaving thicker weft yarns.

The device according to this invention is preferably provided with a movable pusher element that can be operated in order to bring a weft into a first and into a second position in relation to the yarn carrier, whereby this can, respectively cannot be carried along by the yarn carrier.

Such a pusher element can be moved by means of a very simple and inexpensive actuator, such as for example an electromagnet with plunger or a pneumatic cylinder. A vertical movement over a rather small height can moreover already be sufficient.

The device according to the invention in a very simple and efficiently operating embodiment comprises a yarn carrier which is connected to the weaving batten of the weaving machine. No expensive and complex drive device is necessary, while the yarn carrier is nevertheless driven in a very operationally safe manner, synchronous with the beating-up movements, in order to bring wefts at the correct moment within the feed area of a weft insertion means.

With another preferred embodiment of the device according to this invention the pusher element is connected to the frame of the weaving machine.

The device according to this invention can also be provided with a yarn carrier which can be operated in order to take a first or a second position, whereby this can, respectively cannot, carry along a weft.

The yarn carrier preferably has an upper surface inclined upward from a front rim, provided with a catch edge behind which a weft can hook on in order to be carried along to the aforesaid feed area.

The front rim and the upwardly inclined upper surface are particularly well suited for as it were catching a weft in the course of the movement of the yarn carrier.

In its most preferred embodiment the yarn carrier comprises a carrier edge which is formed by a transverse rim of the upper surface, while the yarn carrier can be placed in a first position whereby the transverse rim is directed upward in order to enable a weft extending above the yarn carrier to hook on behind the carrier edge, and can be placed in a second position whereby the transverse rim is directed downward in order to prevent a weft thread extending above the yarn carrier from hooking on behind this carrier edge.

The yarn carrier can for example be placed in its first and its second position by a rotation thereof through a small angle. This can occur with very simple drive means, such as for example a pneumatic cylinder or a rotary motor.

The yarn carrier is preferably implemented knife-shaped with an upwardly curved upper surface. This shape is ideal for picking up a weft.

In another embodiment this device comprises a cutting and clamping device, which can be operated in order to cut through and to clamp a weft.

The device can furthermore also be provided in order in successive operating cycles to offer two or more weft threads to respective weft insertion means, while the device comprises a yarn carrier for each weft which is provided in order to be moved by a weaving machine drive in order to bring a weft within the aforesaidfeed area, while the device can be operated in order to bring the weft and the yarn carrier into a first and a second mutual position, and while the weft in the first mutual position can, and in the second mutual position cannot be carried along by the yarn carrier to the aforesaid feed area.

In that which follows two possible embodiments of an offering device for wefts according to this invention are described in detail. This specification only serves to explain further the characteristics and the operation of a device according to this invention, and may therefore not be considered as a restriction on the protection claimed for this invention in the claims of this patent application.

In this specification reference is made by means of reference numbers to the figures attached hereto. These figures are perspective views of a triple offering device for wefts on a three-rapier weaving machine, whereby the middle offering device in FIGS. 1 through 8 is a first embodiment, and in FIGS. 9 through 16 is a second embodiment of a device according to this invention. These figures show for each embodiment four different positions in the course of the operation of the device, whereby two successive figures in each case show the same position from a different direction of view. Of the three-rapier weaving machine in each case only the three rapiers and a number of parts are partially represented.

BRIEF DESCRIPTION OF THE DRAWINGS

Of FIGS. 1 through 8, in which the first embodiment of the middle offering device according to this invention has been represented.

Of FIGS. 9 through 16, in which the second embodiment of the middle offering device according to this invention has been represented.

DETAILED DESCRIPTION

Figure 1:
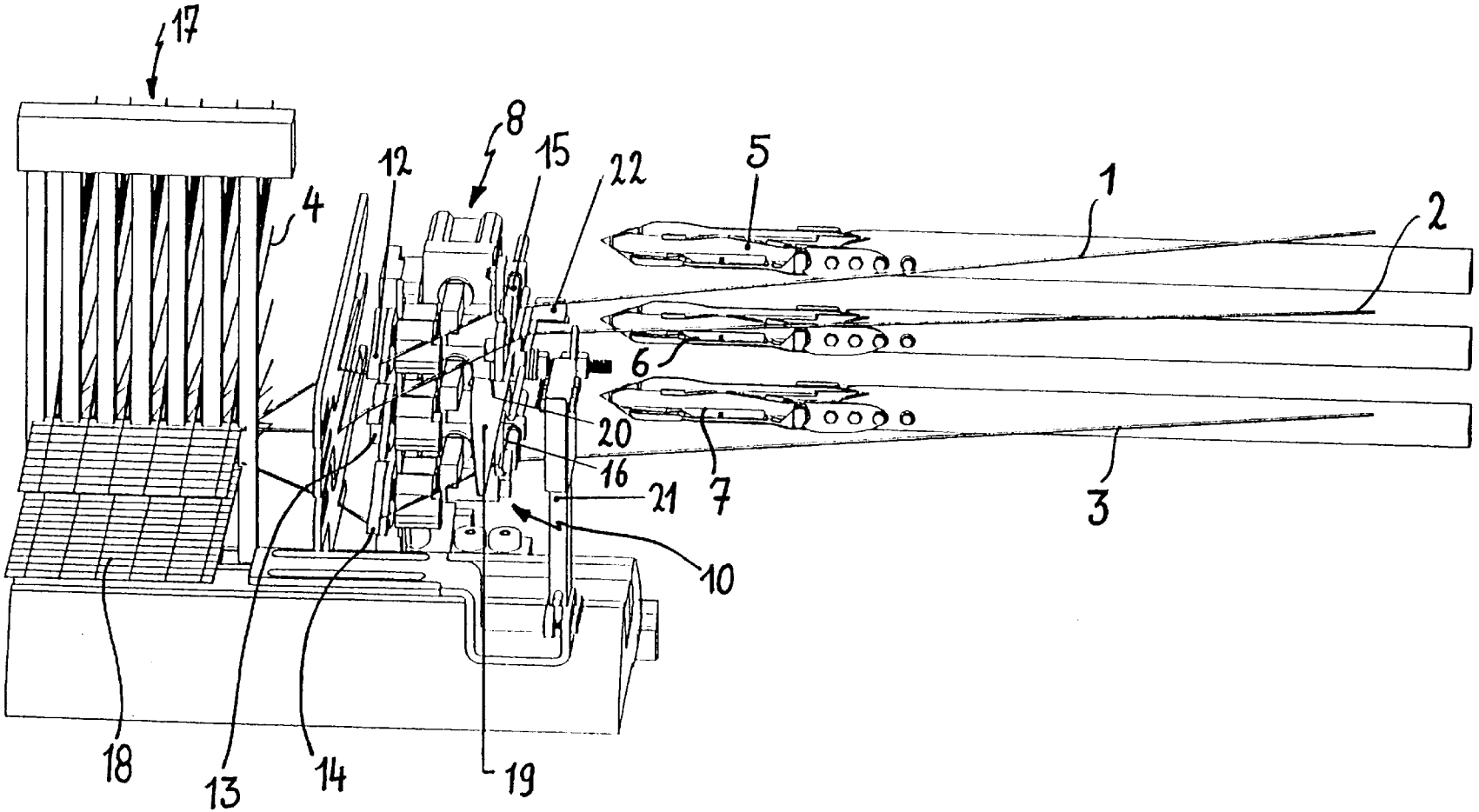
FIGS. 1 and 2 show a position in which the device is ready to carry along all wefts to the rapiers.

The offering device for wefts represented in the figures is disposed on a face-to-face weaving machine with three rapier systems operating one above the other for the insertion of three wefts (1), (2), (3) between warp yarns (4) per weft insertion cycle. Each rapier system has an insert rapier (5), (6), (7) which is driven to move in and out of a shed in the course of each insertion cycle in order to bring a carried along weft (1), (2), (3) to approximately halfway in this shed, and a gripper rapier (not represented in the figures) which is moved in and out of this shed from the other shed side in order to receive the weft thread in the shed from the insert rapier and pull it through to the other side of the shed.

The weaving machine is provided with a device for automatically offering respective weft threads (1), (2), (3) to the insert rapiers (5), (6), (7) in the course of each insertion cycle. These wefts are fed from supply packages not represented in the figures. This device consists of a top (8), a middle (9) and a bottom offering device (10), which are provided in order to work together respectively with the top (5), the middle (6) and the bottom insert rapier (7). The top (8) and the bottom device (10) are known offering devices which are not provided for performing a weft cancellation. The middle device (9) on the other hand is provided for effecting a weft cancellation and is implemented according to this invention.

The top (8) and the bottom offering device (10) comprise weft cutters (12), (14) disposed on the weaving batten (11) which are provided in order to cut through and to clamp a weft thread (1), (3). These offering devices (8), (10) also comprise a guiding eye (15), (16) for a weft (1), (3), disposed on the weaving batten (11).

The weaving batten (11) is driven in order in the course of each weft insertion cycle to move back and forth in order to perform the so-called beating-up movement whereby with the weaving reed (17) the just inserted weft thread is pushed against the fell of the fabric of the already formed fabric (18). During this beating-up movement the weft cutters (12), (14) of the top and the bottom offering device (8), (10) are in each case operated in order to cut off the just inserted piece of weft (1), (3) (so that it is no longer connected to the package), and in order to clamp the free extremity of the weft thread fed from the bobbin. Through the return movement of the weaving batten (11) the top and the bottom offering device (8), (10) in each case take a respective clamped weft (1), (3) along to a position whereby the part of these wefts (1), (3) extending between the clamping means and the guiding eye (15), (16) traverses the movement path of a rapier (5), (7) and can therefore be brought by the rapier into a shed between the warp yarns (4).

The middle passing device (9) according to this invention also comprises weft cutters (13) provided on the weaving batten (11), but in place of a guiding eye a carrier spoon (19) is provided on the weaving batten. This carrier spoon (19) is an elongated element with a limited thickness and a width which gradually decreases from a rear transverse rim (20) in order to end almost pointed in front, and is curved downward from the aforesaid rear rim (20) so that the carrier spoon (19) has a curved upper surface.

With the first embodiment according to FIGS. 1 through 8 this carrier spoon (19) is secured in a fixed position on the weaving batten (11) and the device has a pusher element (22), which can be moved up and down by means of a compressed air cylinder (21), with which the middle weft (2) can be pushed upward. This pusher element (22) has approximately the same form as the yarn carrier.

If the position of the middle weft (2) is not influenced by the pusher element (22) this weft is in a position whereby it can be picked up by the carrier spoon (19) in the course of the beating-up movement of the weaving batten. This weft remains hooked behind the rear transverse rim (20) of the carrier spoon (19) and is because of this carried along in the course of the return movement of the weaving batten (11) to above the movement path of the middle rapier (6). The weft cutters of the middle offering device (9) are operated in order to cut through and to clamp the weft (2), so that the clamping means bring the weft (2) below the aforesaid movement path. Because of this the part of the weft extending between these clamping means and the carrier spoon (19) traverses the movement path of the rapier (6), so that the weft (2) can be carried along by this rapier (6).

If the middle weft (2) is pushed upward by the pusher element (22), the weft (2) extends higher than the upper surface of the carrier spoon (19), so that this weft (2) does not remain hooked behind the rear rim (20) and can therefore not be carried along by the carrier spoon (19). The weft cutters (13) are therefore not operated for cutting through and clamping the weft thread (2). The fed weft (2) therefore remains attached to the yarn part inserted in the fabric (18). Since this weft (2) is not carried along, neither by the carrier spoon (19) nor by the clamping means of the weft cutters (13) this weft remains in the same position in the course of the return movement of the weaving batten (11). No friction at all is exerted on the weft (2), so that this yarn can be maintained sufficiently under tension and is not withdrawn from the fell of the fabric in the course of the return movement of the weaving batten (11).

Figure 2:
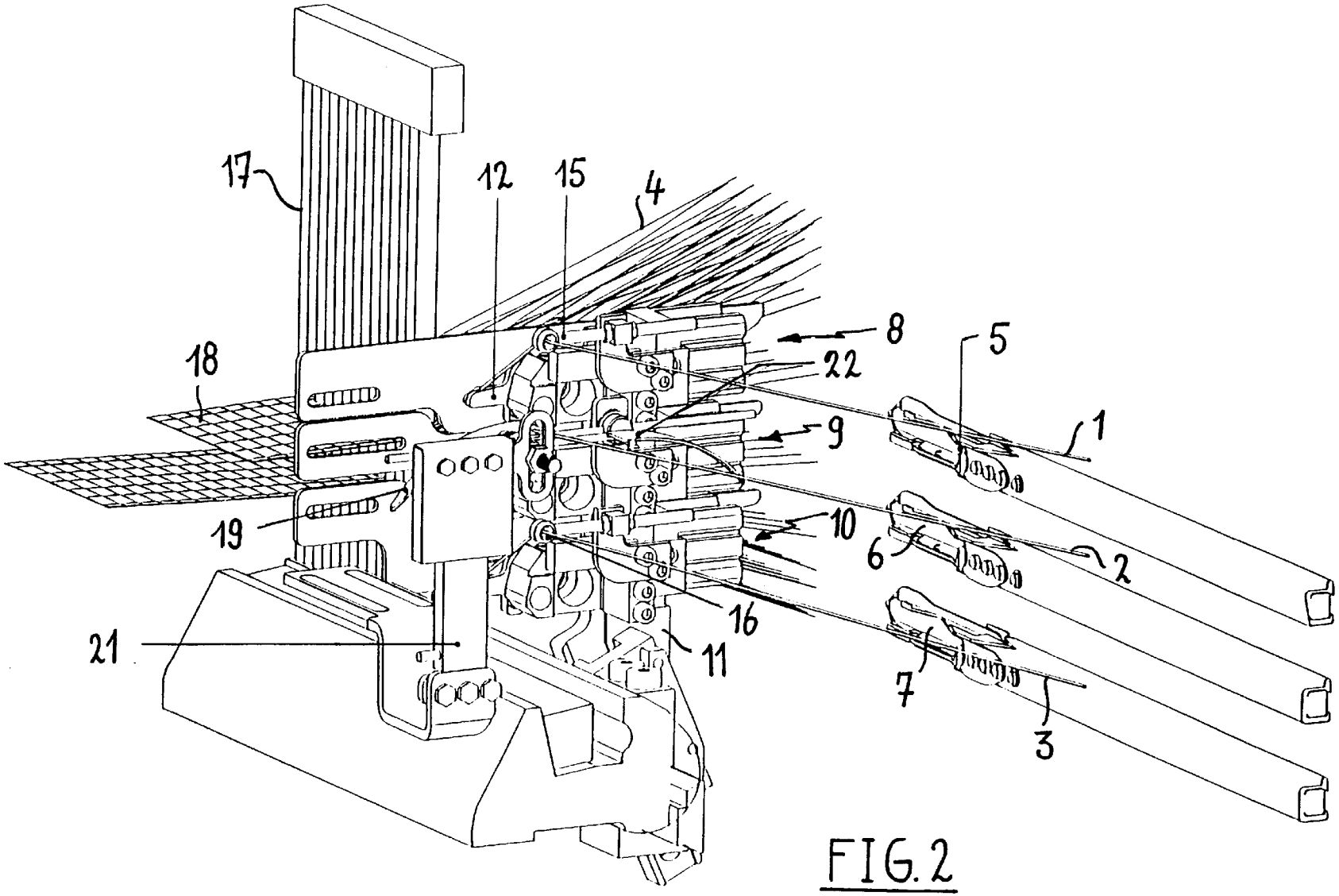

In FIGS. 1 and 2 the offering device is represented in the situation whereby the weaving batten (11) is in the beating-up position. The weft cutters (12), (13), (14) and the guiding eyes (15), (16) are therefore in their most forward position. The parts of the three wefts (1), (2), (3) inserted in the course of the previous weft insertion cycle are not cut off. The pusher element (22) is in its lowest position and therefore does not push the middle weft (2) upward. In this situation (see FIGS. 3 and 4), in addition to the top (1) and the bottom weft (3), the middle weft (2) will also be carried along.

Figure 3:
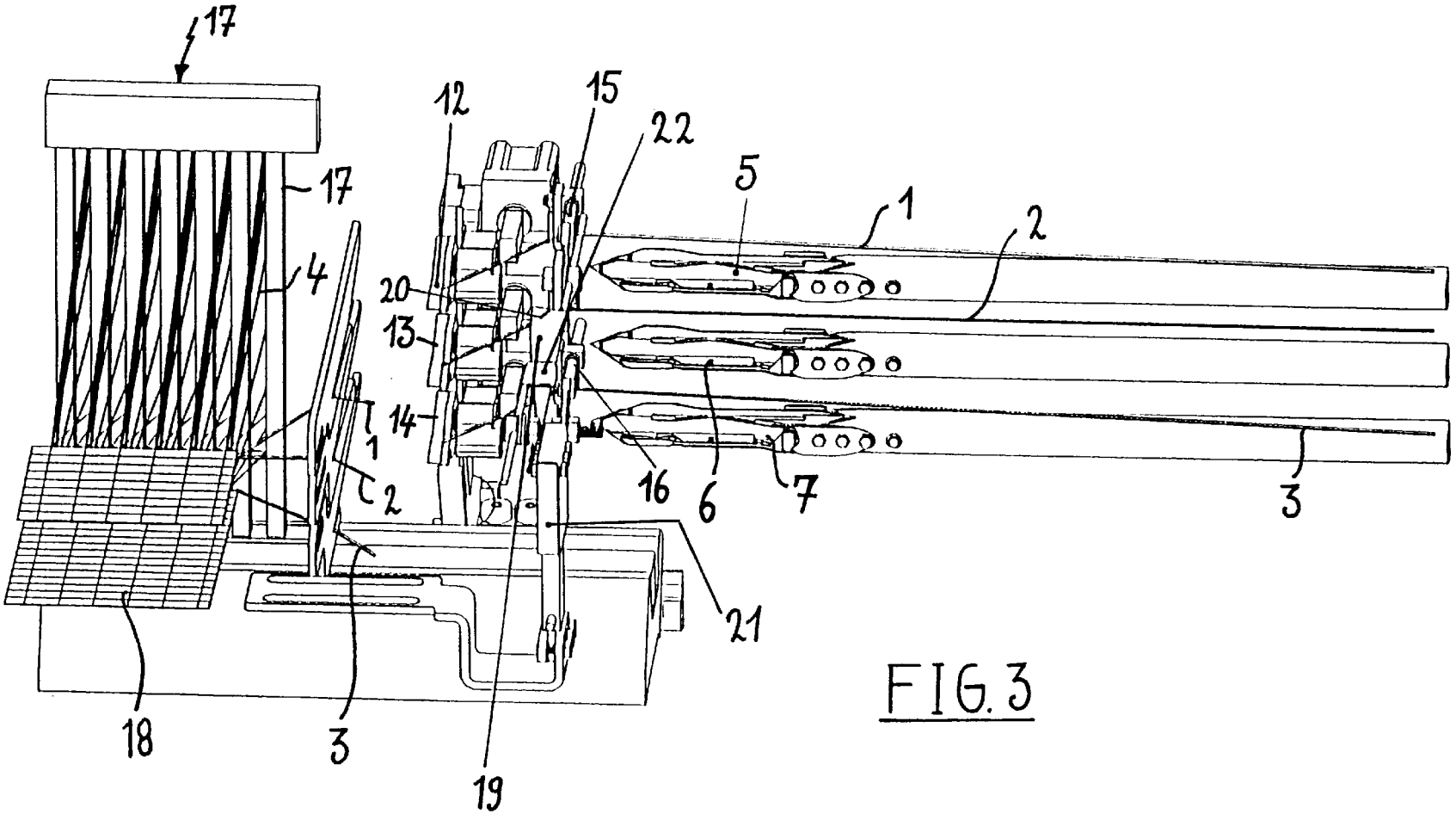
FIGS. 3 and 4 show a position in which the device has brought the wefts within the feed area of a respective rapier.
Figure 4:
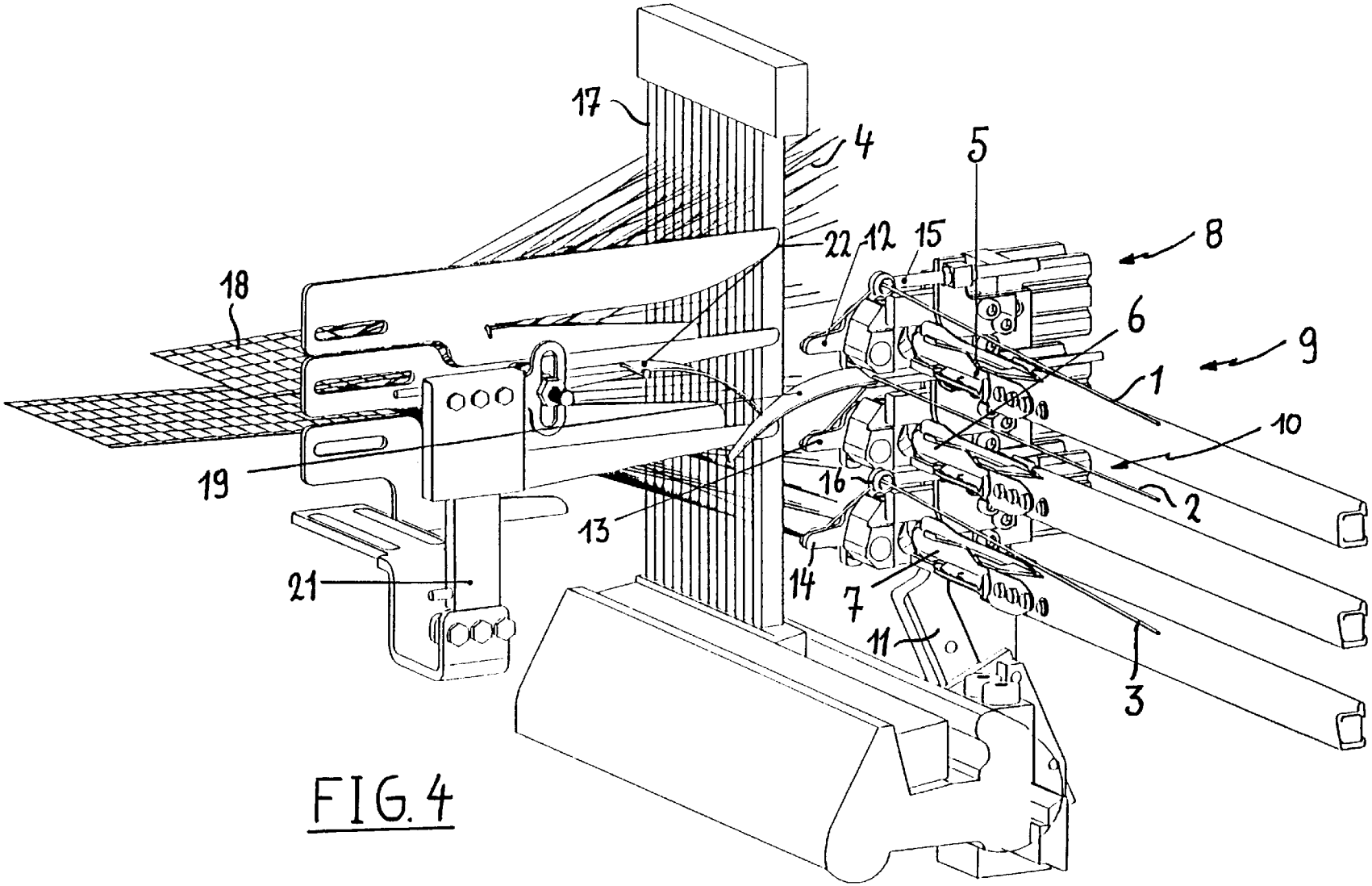

In FIGS. 3 and 4 the device can be seen in the situation following thereafter whereby the three wefts (1), (2), (3) are cut through and clamped by their weft cutters (12), (13), (14) and are carried along by their respective offering devices (8), (9), (10) to within the feed area of the rapiers (5), (6), (7). The top (1) and the bottom weft thread (3) are carried along by the clamping means and the guiding eyes (15), (16) on the weaving batten (11), while the middle weft (2) is also carried along by the clamping means of the middle weft cutters (13), and furthermore in the course of the return movement of the weaving batten (11) has remained hooked behind the transverse rim (20) of the carrier spoon (19).

Figure 5:
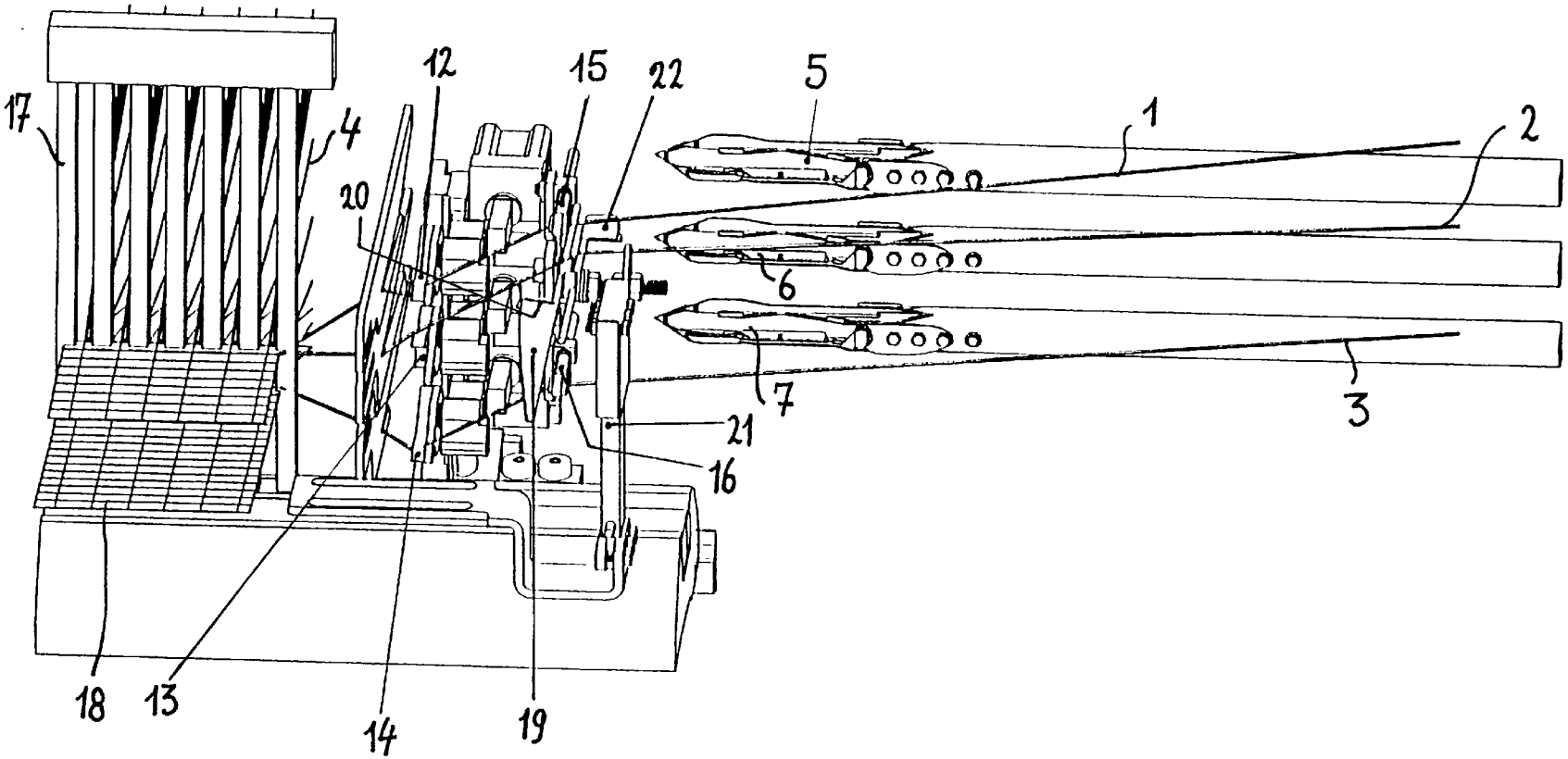
FIGS. 5 and 6 show a position in which the device is ready to carry along the top and bottom weft to a rapier, and to cancel the insertion of the middle weft.
Figure 6:
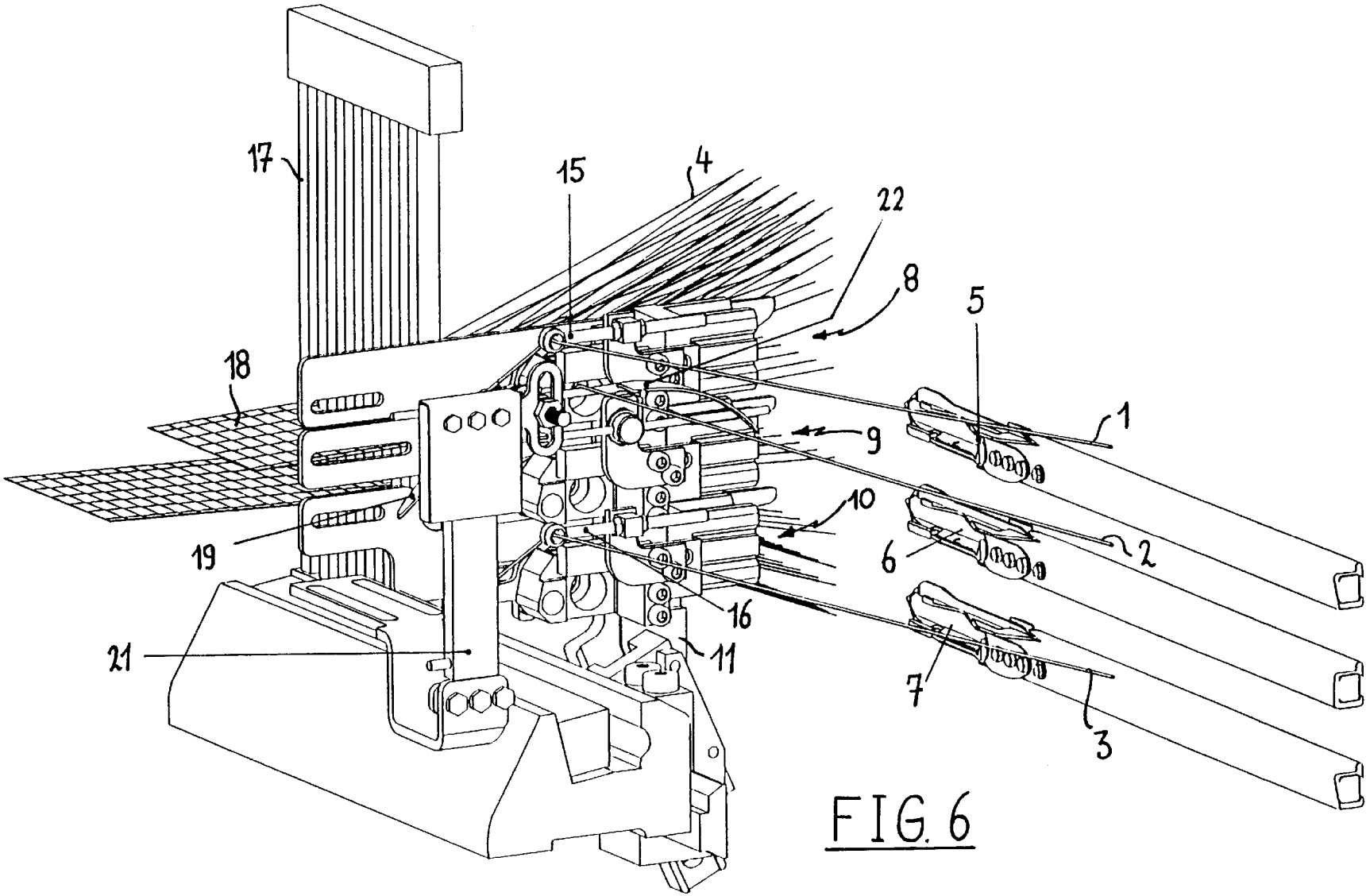

The situation in FIGS. 5 and 6 differs from the situation in FIGS. 1 and 2 only because of the fact that the pusher element (22) is now in its highest position and pushes the middle weft (2) upward. In this situation (see FIGS. 7 and 8) the middle weft (2) will not be able to hook on behind the transverse rim (20) of the carrier spoon (19) and will therefore not be carried along by this carrier spoon (19) in the course of the return movement of the weaving batten (11). The carrier spoon (19) moves through below the weft (2).

Figure 7:
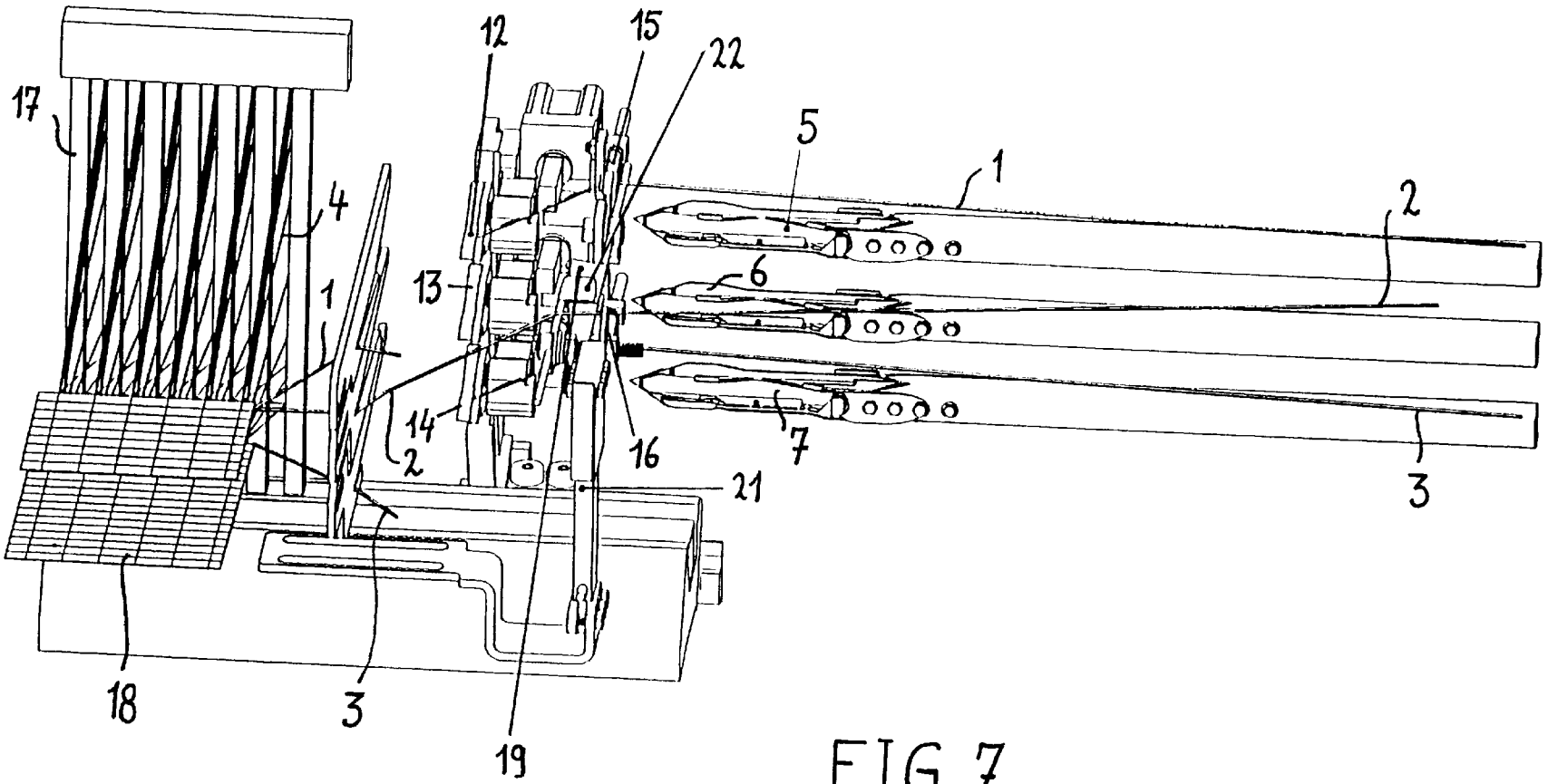
FIGS. 7 and 8 show a position in the course of the implementation of the weft cancellation of the middle weft.
Figure 8:
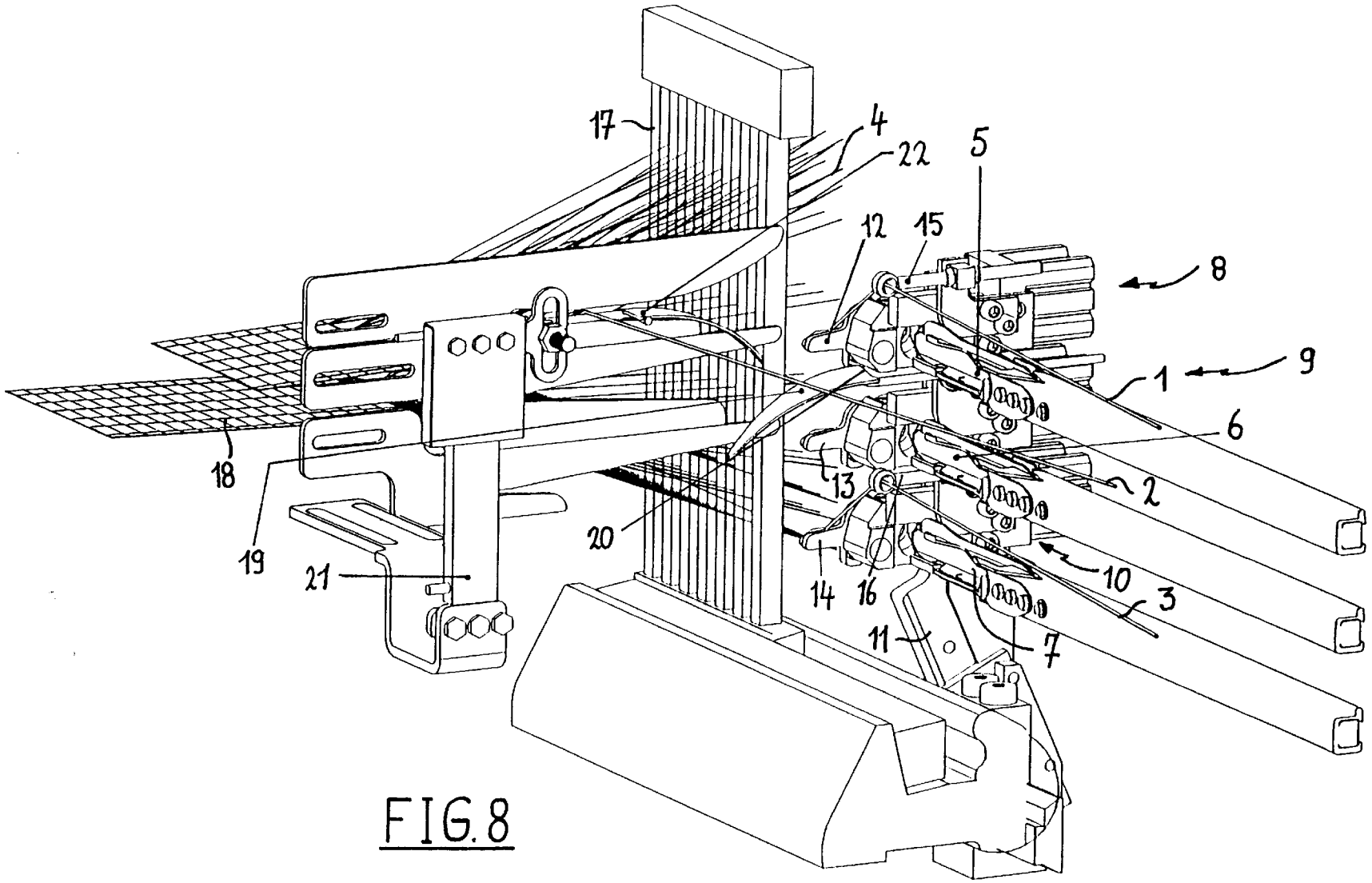

In FIGS. 7 and 8 the device can be seen in the situation following thereafter whereby the top (1) and the bottom weft (3) are cut through and clamped by their weft cutters (12), (14) and are brought by the respective clamping means and guiding eyes (15), (16) within the carrier range of the rapiers (5), (7), while the middle weft (2) is not cut through and clamped by its weft shears (13) and is neither carried along by the clamping means, nor by the carrier spoon (19).

With the second embodiment according to FIGS. 9 through 16 no pusher element (22) is provided and the carrier spoon (19) is secured to a rotatable spindle (23) extending in the longitudinal direction of the carrier spoon (19). The carrier spoon (19) has a part extending laterally in relation to the spindle in the direction of the weft cutters (13). Through rotation of the spindle (23) the carrier spoon (19) can be placed in a first position whereby the laterally extending part of the transverse rim (20) is directed upward from the spindle, and can be placed in a second position whereby the aforesaid extending part of the transverse rim (20) is directed downward.

If the carrier spoon (19) is placed in the first position (with upwardly directed transverse rim) a weft (2) extending above the carrier spoon (19) will be carried along by the transverse rim (20) if the carrier spoon (19) moves backward. If the carrier spoon (19) is in the second position (with downwardly directed transverse rim) a weft (2) extending above the carrier spoon (19) will not be carried along in the course of the return movement of the weaving batten (11). In this manner by influencing the position of the carrier spoon (19) it can be determined whether or not a weft (2) is carried along by this carrier spoon (19).

The rotation of the spindle (23) in order to control the position of the carrier spoon (19) occurs by means of a rotary motor or a pneumatic cylinder (not represented in the figures).

Figure 9:
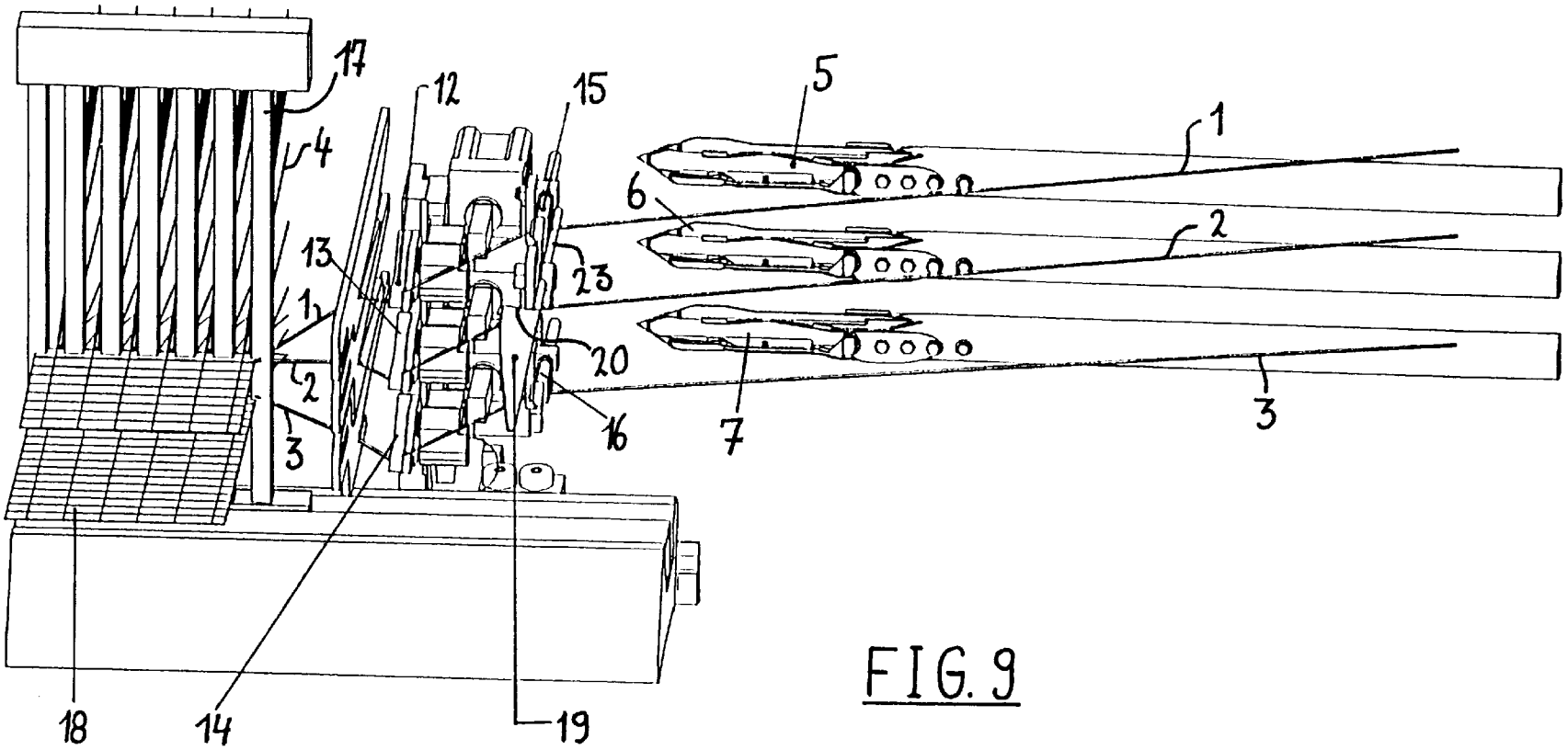
FIGS. 9 and 10 show a position in which the device is ready to carry along all wefts.
Figure 10:
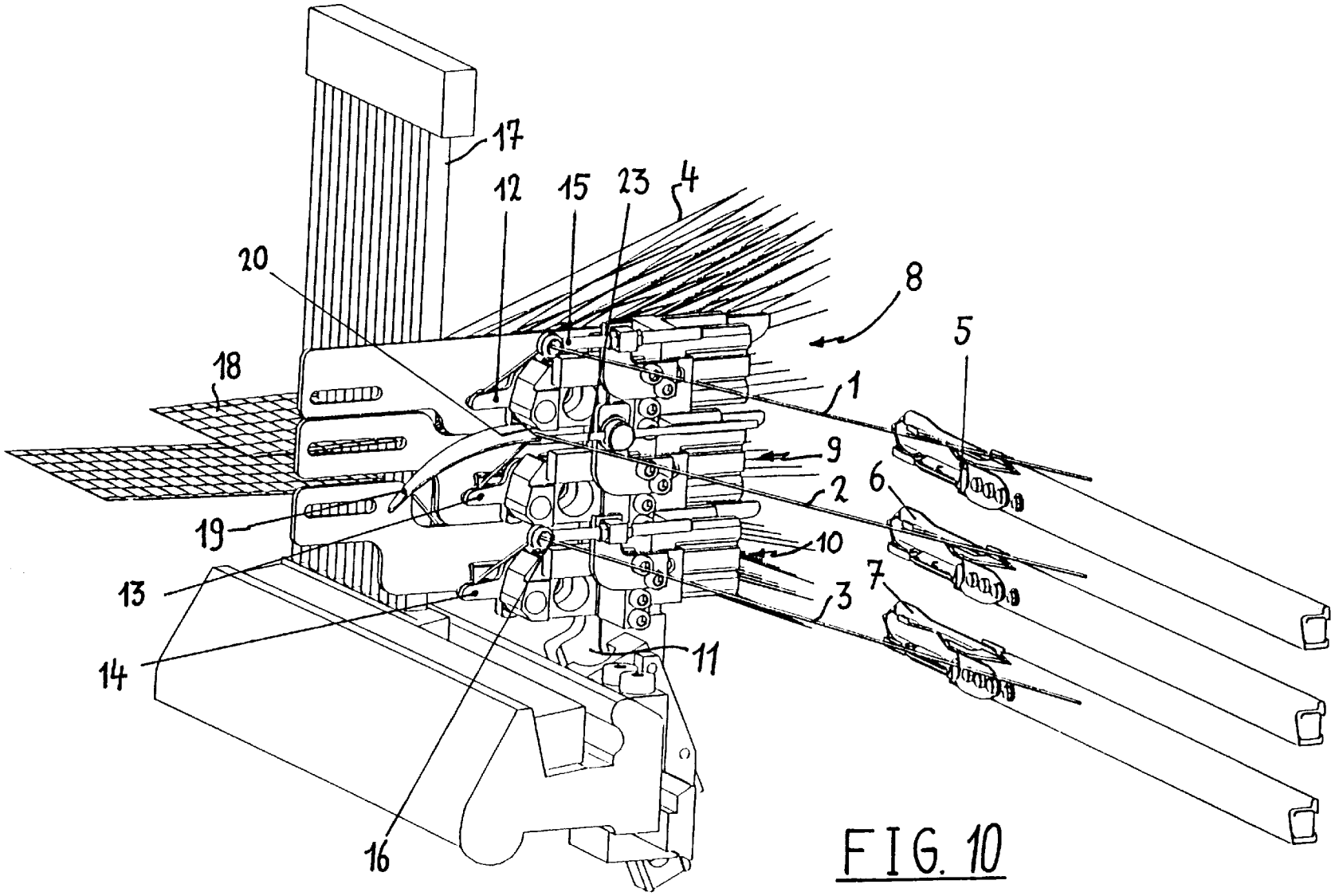

In FIGS. 9 and 10 the offering device is represented in the situation whereby the weaving batten (11) is in the beating-up position. The weft cutters (12), (13), (14) and the guiding eyes (15), (16) are therefore in their most forward position. The parts of the three wefts (1), (2), (3) inserted in the course of the previous weft insertion cycle are not cut off. The carrier spoon (19) is rotated into the first position with upwardly directed transverse rim (20). In this situation (see FIGS. 11 and 12), in addition to the top (1) and the bottom weft (3), the middle weft (2) will also be carried along.

Figure 11:
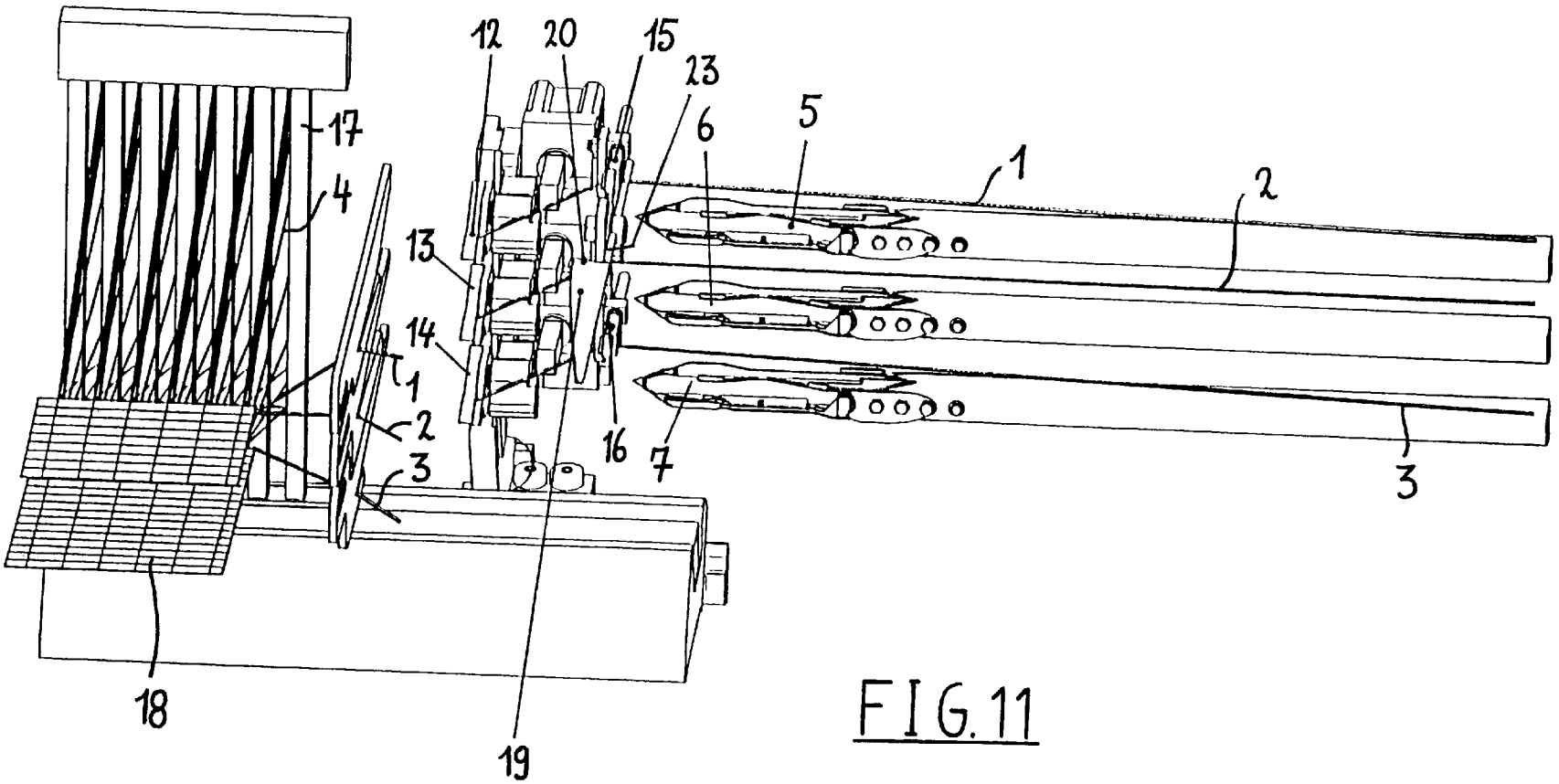
FIGS. 11 and 12 show a position in which the device has brought the wefts within the feed area of a respective rapier.
Figure 12:
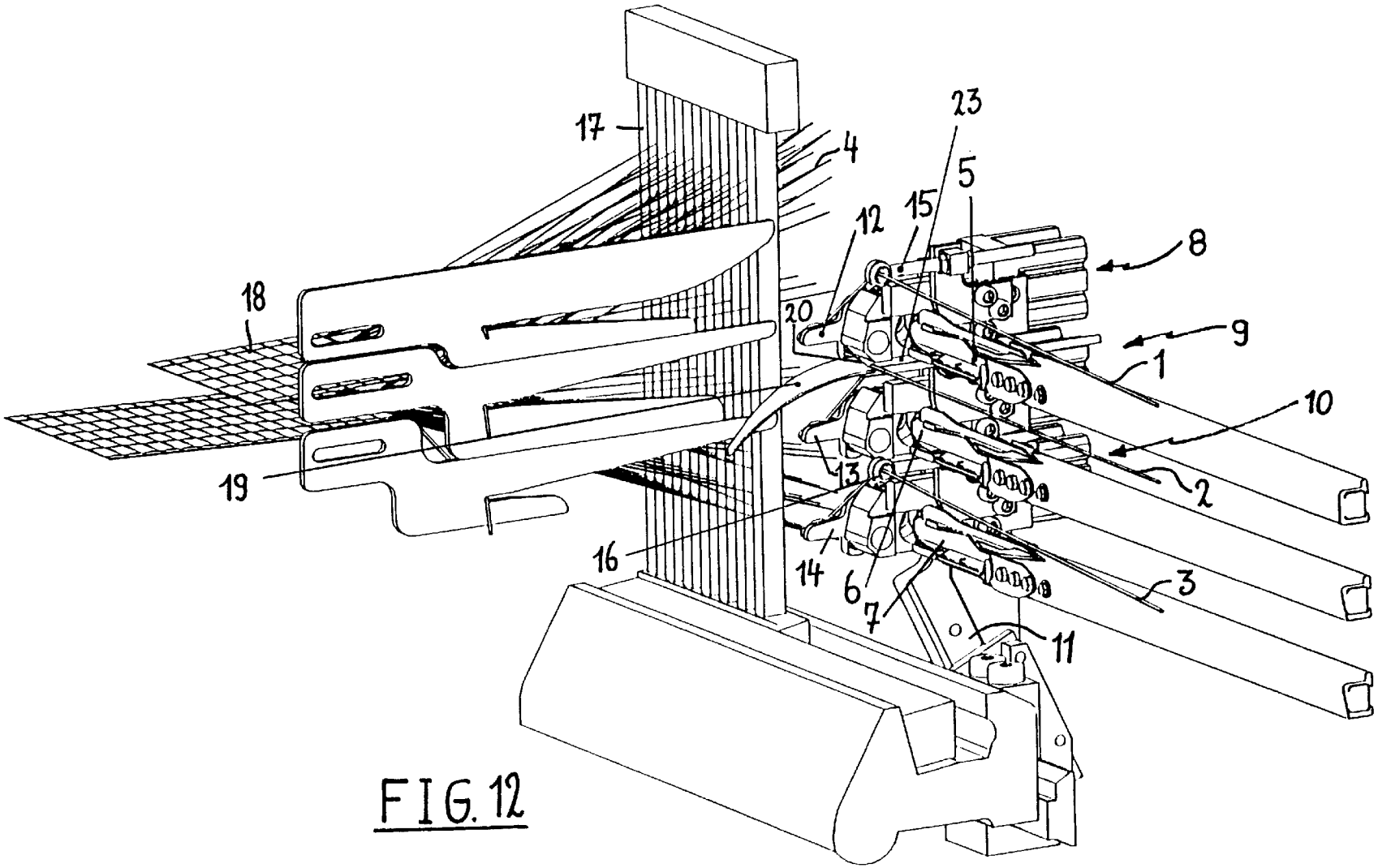

In FIGS. 11 and 12 the device can be seen in the situation following thereafter whereby the three wefts (1), (2), (3) are cut through and clamped by their weft cutters (12), (13), (14) and are carried along by their respective offering devices (8), (9), (10) to within the carrier range of the rapiers (5), (6), (7). The top (1) and the bottom weft (3) are carried along by the clamping means and the guiding eyes (15), (16) on the weaving batten (11), while the middle weft (2) is carried along by the clamping means of the middle weft cutters (13) and furthermore in the course of the return movement of the weaving batten (11) has remained hooked behind the transverse rim (20) of the carrier spoon (19).

Figure 13:
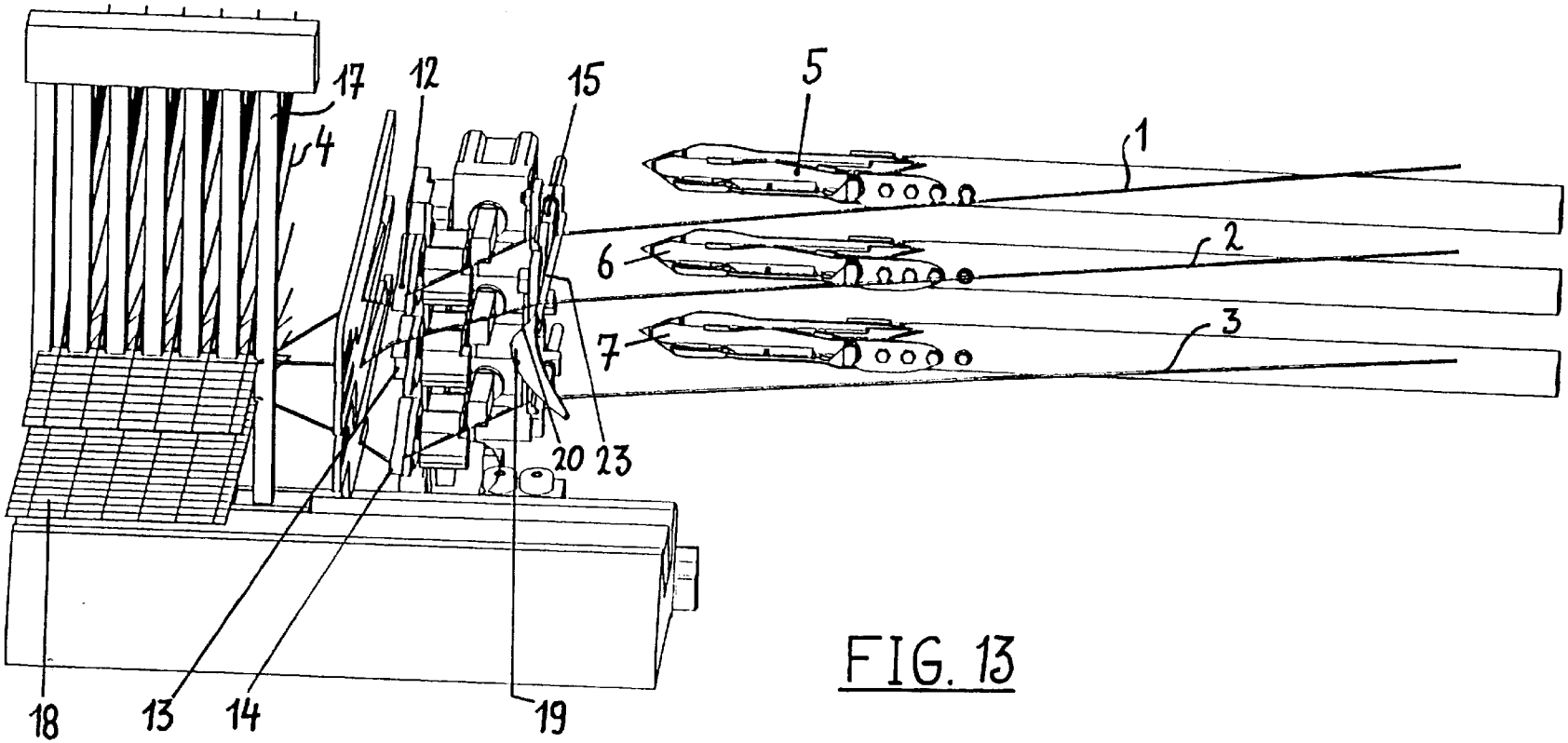
FIGS. 13 and 14 show a position in which the device is ready to carry along the top and bottom weft, and to cancel the insertion of the middle weft.
Figure 14:
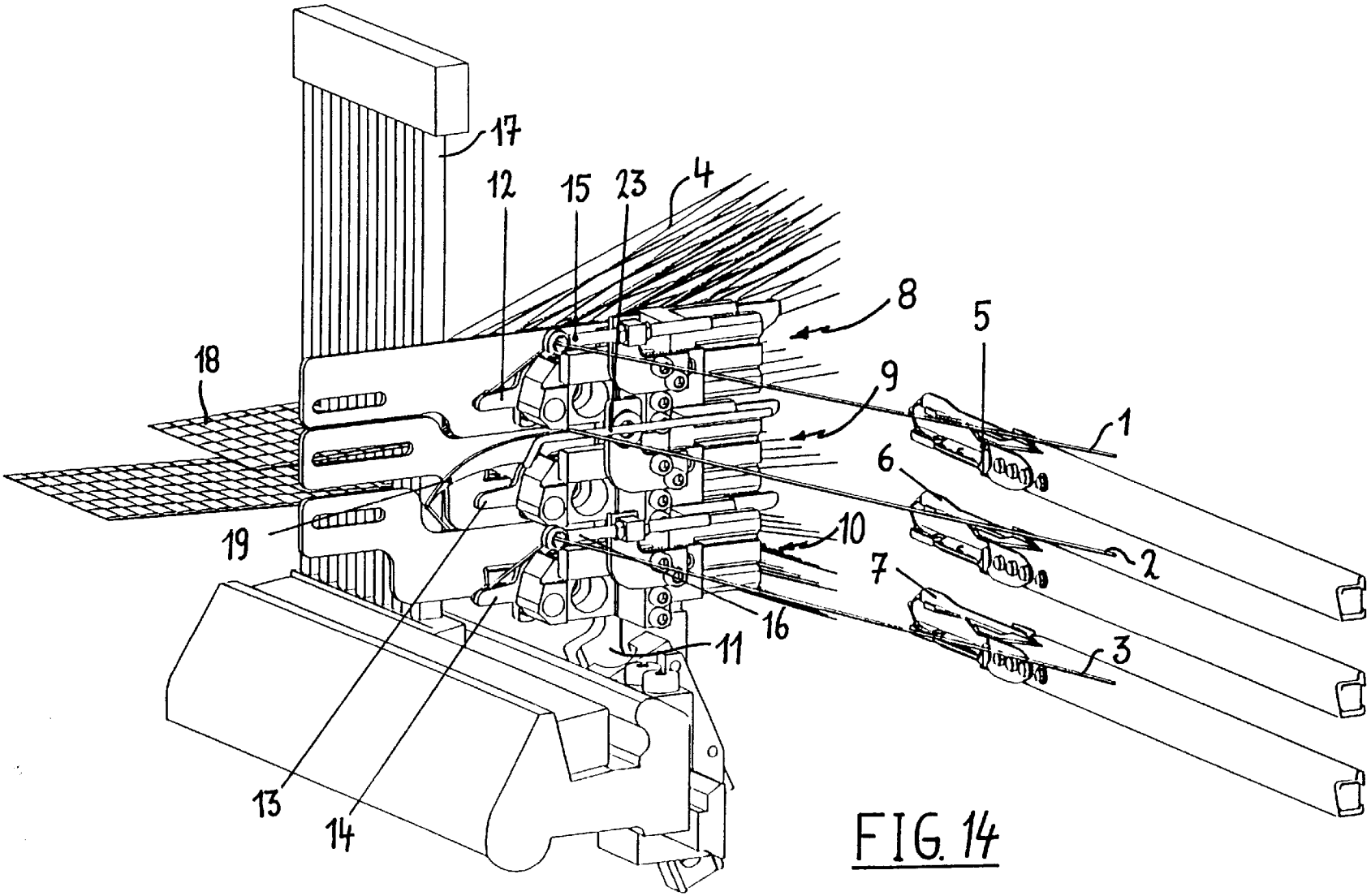

The situation in FIGS. 13 and 14 differs from the situation in FIGS. 9 and 10 only because of the fact that the carrier spoon is now rotated into its second position with downwardly directed transverse rim (20). In this situation (see FIGS. 15 and 16) the middle weft (2) will not be able to hook on behind the transverse rim (20) of the carrier spoon (19) and will therefore not be carried along in the course of the return movement of the weaving batten (11) .

Figure 15:
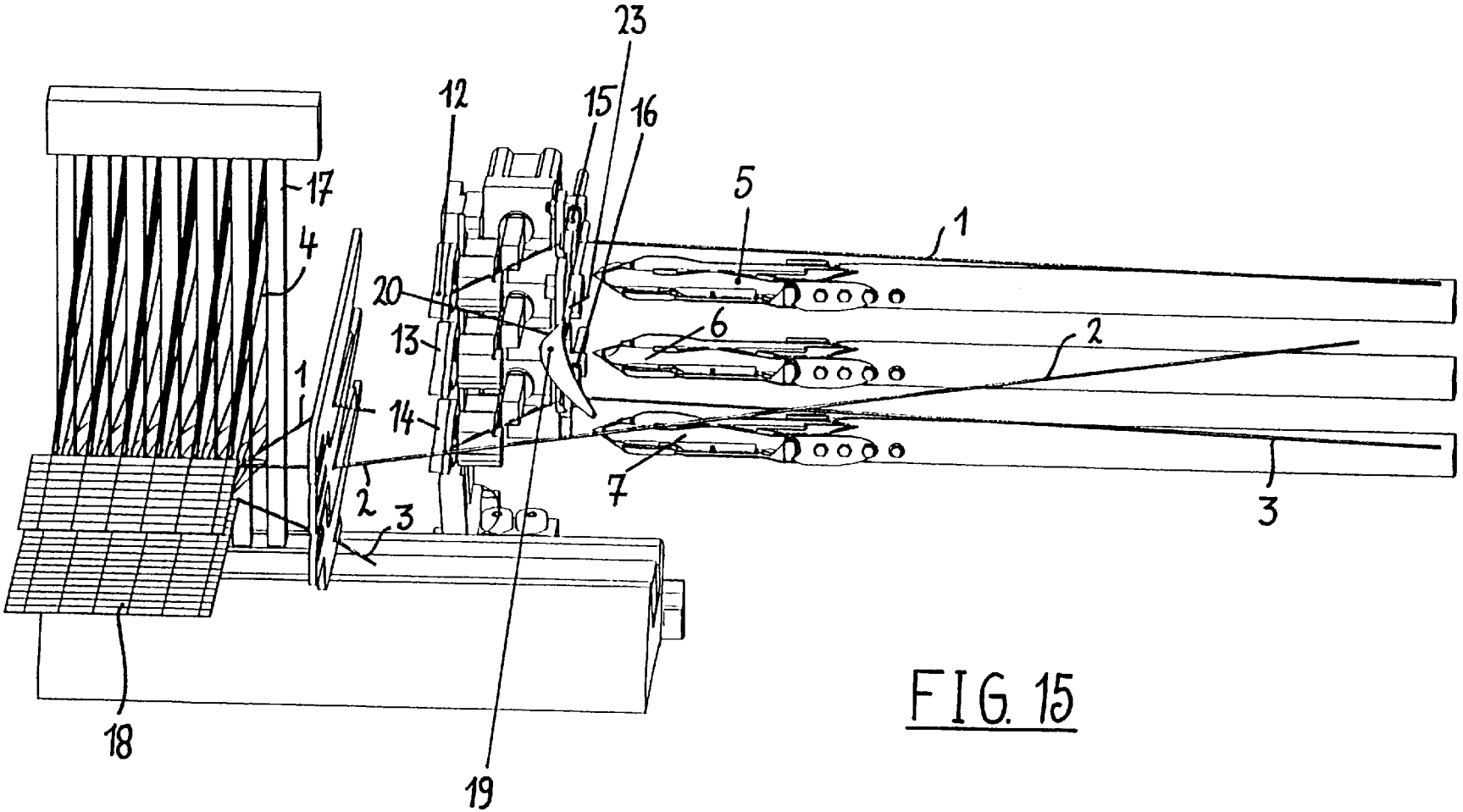
FIGS. 15 and 16 show a position in the course of the implementation of the weft cancellation of the middle weft.
Figure 16:
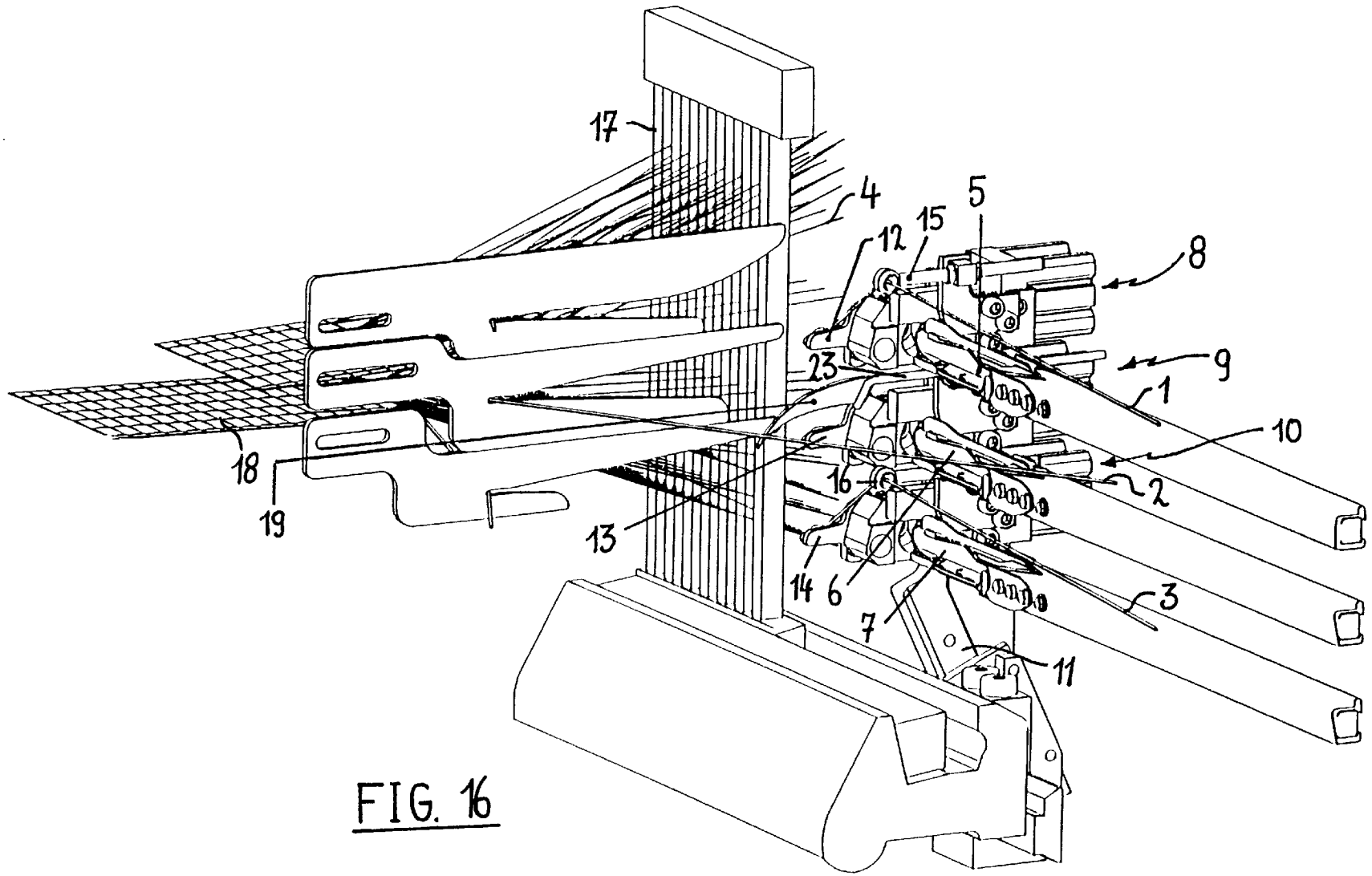

In FIGS. 15 and 16 the device can be seen in the situation following thereafter whereby the top (1) and the bottom weft (3) are cut through and clamped by their weft shears (12), (14) and are brought by the respective clamping means and guiding eyes (15), (16) within the carrier range of the rapiers (5), (7), while the middle weft (2) is not cut through and clamped by its weft shears (13) and is neither carried along by the clamping means, nor by the carrier spoon (19).

Such a triple offering device can also be implemented with two or three offering devices which are suitable for weft cancellation and are implemented according to this invention.

It is obvious that several offering devices with two offering devices or with more than three offering devices, of which at least one is implemented according to this invention, and weaving machines provided with such a multiple offering device, also fall within the scope of this patent protection.

What is claimed is:

1. Device for offering weft threads (1), (2), (3) to at least one weft insertion means (5), (6), (7) on a weaving machine, the device can be operated in order either to bring a weft within a feed area of the weft insertion means so that a weft can be inserted, or to hold it out of this feed area to effect a weft cancellation, characterized in that the device comprises a yarn carrier (19), a weaving machine drive connected to the carrier for moving the carrier to bring said weft (2) and the carrier within the aforesaid feed area, such that the weft (2) and the yarn carrier (19) are brought into a first and a second mutual position, and wherein the weft (2) in the first mutual position can be carried along by the yarn carrier (19) to the aforesaid feed area and wherein the weft in the second mutual position cannot be carried along by the yarn carrier to the aforesaid feed area.

2. Device according to claim 1 characterized in that the device is provided with a movable pusher element (22) that can be operated in order to bring the weft (2) into the first and into the second position in relation to the yarn carrier (19), for being carried along or not carried along by the yarn carrier (19).

3. Device according to claim 2 characterized in that the pusher element (22) is adapted to be connected to the frame of the weaving machine.

4. Device according to claim 1 characterized in that the yarn carrier (19) is adapted to be connected to the weaving batten (11) of the weaving machine.

5. Device according to claim 1 characterized in that the yarn carrier (19) is adapted to be operated in order to occupy the first or the second position, (2).

6. Device according to claim 5, characterized in that the yarn edge (20) is formed by a transverse rim of the upper surface, that the yarn carrier (19) can be placed in the first position, whereby the transverse rim (20) is directed upward, in order to enable the weft (2) extending above the yarn carrier (19) to hook on behind the carrier edge (20), and that the yarn carrier (19) can be placed in the second position, whereby the transverse rim (20) is directed downward, in order to prevent a weft (2) extending above the yarn carrier (19) from hooking on behind the carrier edge (20).

7. Device according to claim 1 characterized in that the yarn carrier (19) has an upper surface inclined upward from a front rim, provided with a carrier edge (20) behind which a weft (2) can hook on in order to be carried along to the aforesaid feed area.

8. Device according to claim 1 characterized in that the yarn carrier (19) is knife-shaped with an upwardly curved upper surface.

9. Device according to claim 1 characterized in that the device comprises a cutting and clamping device (13) for cutting and clamping a weft.

10. Device according to claim 1 characterized in that the device is adapted to be provided in order in successive operating cycles to pass two or more wefts (1), (2), (3) to respective weft insertion means (5), (6), (7), wherein the device comprises a yarn carrier (19) for each weft (1), (2), (3), said weaving machine drive being adopted for moving the yarn carrier in order to bring each weft (2) within the aforesaid feed area, the device being further adapted to be operated in order to bring the weft (2) and the yarn carrier (19) into the first and the second mutual position, and that the weft (2) in the first mutual position can, and in the second mutual position cannot, be carried along by the yarn carrier (19) to the aforesaid feed area.

11. Weaving machine comprising a device for offering weft threads to at least one weft insertion means on a weaving machine, the device being adapted to either bring a weft within a feed area of the weft insertion means so that a weft can be inserted, or to hold the weft out of the feed area to effect a weft cancellation, a yarn carrier, a weaving machine drive connected to the carrier for moving the carrier to bring the weft (2) and the carrier within the aforesaid feed area, such that the weft (2) and the yarn carrier (19) are brought into a first and a second mutual position, and wherein the weft (2) in the first mutual position can be carried alone by the yarn carrier (19) to the aforesaid feed area and wherein the weft in the second mutual position cannot be carried along by the yarn carrier to the aforesaid feed area.

* * * * *